United States Patent [19]

Weigl et al.

[11] 3,989,274

[45] Nov. 2, 1976

[54] DEVICE FOR SKI BINDINGS

[75] Inventors: Erwin Weigl, Brunn am Gebirge; Josef Svoboda, Schwechat, both of Austria

[73] Assignee: Gertsch AG, Zug, Switzerland

[22] Filed: Sept. 19, 1975

[21] Appl. No.: 614,890

[30] Foreign Application Priority Data

Sept. 20, 1974 Austria ..... 7604/74

[52] U.S. Cl. ..... 280/634

[51] Int. Cl.[2] ..... A63C 9/22

[58] Field of Search ..... 280/11.35 T, 11.35 R, 280/11.35 H, 11.35 E, 11.35 D, 634; 9/310 AA

[56] References Cited

UNITED STATES PATENTS

| | | | |
|---|---|---|---|
| 3,125,349 | 3/1964 | Schweizer | 280/11.35 T |
| 3,172,677 | 3/1965 | Marker | 280/11.35 T |
| 3,361,435 | 1/1968 | Huam | 280/11.35 T |
| 3,489,122 | 1/1970 | Schweizer et al. | 280/11.35 R |
| 3,785,666 | 1/1974 | Salomon | 280/11.35 T |
| 3,857,186 | 12/1974 | Salomon | 280/11.35 E |

*Primary Examiner*—M. H. Wood, Jr.
*Assistant Examiner*—David M. Mitchell
*Attorney, Agent, or Firm*—Woodhams, Blanchard and Flynn

[57] ABSTRACT

A tension adjustment device for a safety ski binding. A device is provided by which the tension on a safety ski binding may be selected and determined without the necessity of a ski boot being present in the binding. There is provided a two-part carriage movable longitudinally of the ski and capable of being fixed at a selected point on the ski. The two parts of said carriage are movable together in one direction due to a manually applied force and are movable relative to each other in the opposite direction against a spring force by a manually operable adjustment device such as an eccentric or through the application of a force to the ski binding carrying part. One of the parts is mounted onto a ski supported base plate and the other of said parts carries the ski binding. With the ski binding free of engagement with the ski boot the adjustment device is operated to select the desired tension for the binding. The two parts of the carriage are then moved together to enable the binding to engage the ski boot and again locked into position on the ski. The adjustment device is now released and the spring acting between the parts of the two-part carriage will cause the binding to bear against the ski boot with the desired pressure.

5 Claims, 4 Drawing Figures

DEVICE FOR SKI BINDINGS

FIELD OF THE INVENTION

The invention relates to a device for ski bindings, comprising a carriage which carries the binding part and a base plate which is secured on the ski and forms a guideway for the carriage, wherein between carriage and base plate there is provided a releasable lock and the binding part rests in its condition of use on the ski boot under the effect of one or more thrust springs.

BACKGROUND OF THE INVENTION

In general the ski boot is held on the ski between two binding parts, of which one is supported movably against the force of a spring in the longitudinal direction of the ski. Thus the ski boot is clamped between the binding parts under a resilient action. How strong this resilient thrust is applied against the ski boot must be determined prior to use and the binding must be adjusted accordingly.

In the known constructions the spring is supported on one end on the movably supported binding part and on the other end on an adjustable and fixable abutment. Therefore, in the non-use condition, the binding is held in an end position by the spring. Upon the user's stepping into the binding, the movable binding part is pressed back against the force of the spring. Thus, if a force indicating mechanism is provided, the thrust force exerted onto the ski boot can be determined only in stepped-in condition. However, adjustment of such binding in stepped-in condition is, as a practical matter, hardly ever possible. Not only can the user not at all reach the adjusting mechanism or do so only with great difficulty, but the adjustment of a tensioned spring requires a substantial force input. Therefore, the user must first step out of the binding in order to be able to operate the adjusting mechanism and even then it is very difficult to attain immediately the correct position of the individual parts. In most cases this operation must be repeated several times.

SUMMARY OF THE INVENTION

The invention has the purpose of avoiding these disadvantages and of producing a device with which the thrust force can be adjusted easily in a simple manner and with which the user can do so in a condition when the boot is not stepped into the binding. This objective is attained by providing a carriage consisting of two plates movable with respect to one another against the force of a thrust spring and which plates are held in a selected position with respect to one another by an adjustable support mechanism which acts against the force of the thrust spring.

Thus, the initial stress, through which the thrust of the spring is effected, can be fixed in any desired position of the binding by the support mechanism. Then the binding is moved, together with two plates which form a carriage, toward the ski boot and is moved to engage said ski boot and is locked onto the ski. By releasing the support mechanism between the two plates, the spring becomes fully effective and presses with the predetermined force against the ski boot. Thus only a one-time and simple manipulation is required for a suitable adjustment.

BRIEF DESCRIPTION OF THE DRAWINGS

The subject matter of the invention is illustrated in one exemplary embodiment in the drawing, in which.

DETAILED DESCRIPTION

Figure 1:
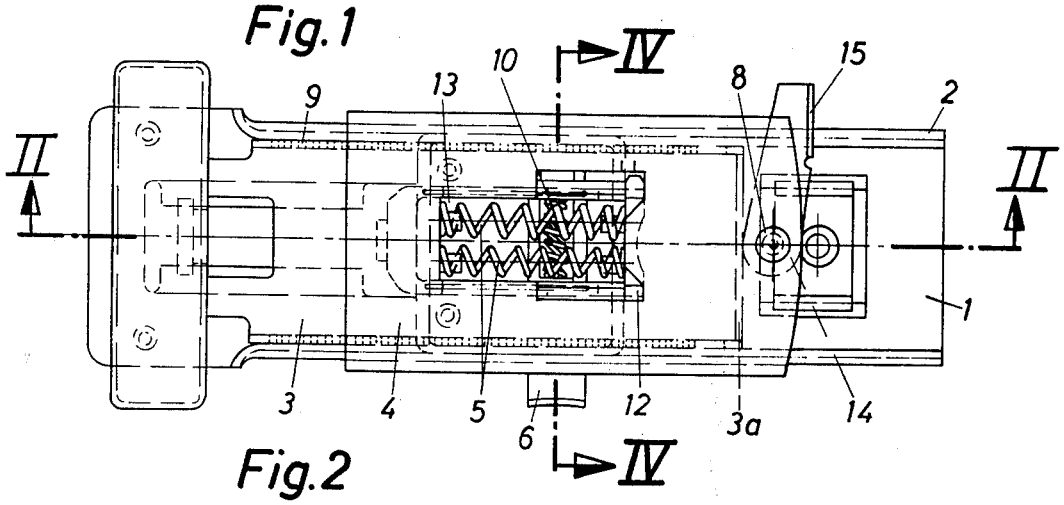
FIG. 1 is a top view of a preferred embodiment of the apparatus.
Figure 2:
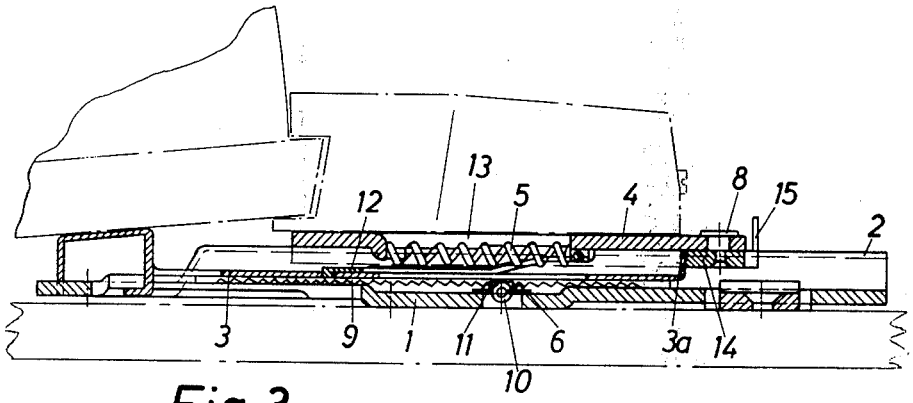
FIG. 2 is a section taken on the line II—II of FIG. 1.
Figure 3:
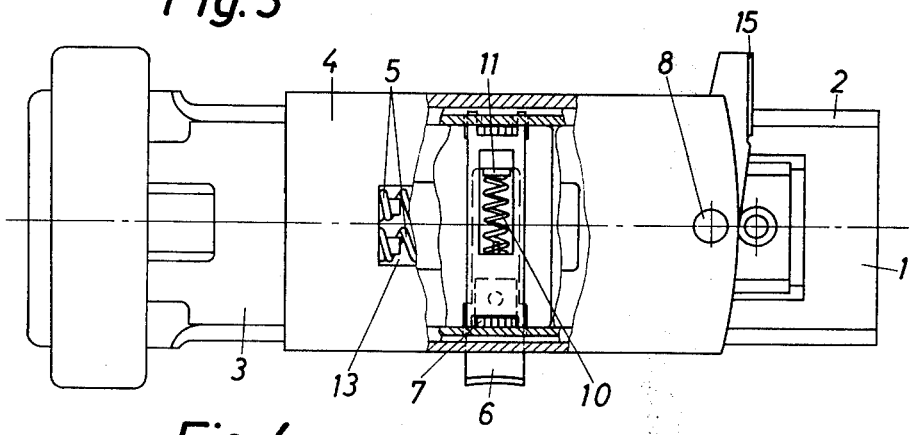
FIG. 3 is a top partially broken view of the apparatus showing portions in the lower level thereof.
Figure 4:
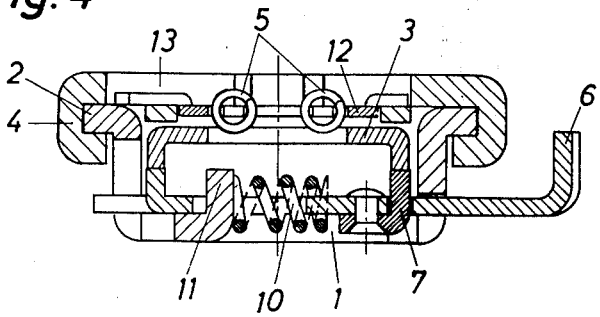
FIG. 4 is a section taken on the line IV—IV of FIG. 1.

As shown in the drawing, there is provided a base plate 1 which forms a guideway 2 for the carriage which consists of stepping plate 3 and guide plate 4. The base plate 1 is mounted on the ski and one binding part is mounted on the guide plate 4. The guide plate 4 is movable relative to the stepping plate 3 through a predetermined zone with or against the force of two side-by-side arranged thrust springs 5.

A slide member 6 is supported transversely movably in the base plate 1. A toothed locator 7 is riveted to this slide member, which toothed locator engages with its teeth a toothed rail 9 provided on the stepping plate 3. This engagement is caused by the spring 10, which at one end is supported on a bent portion 11 of the base plate 1 and at the other end on the toothed locator 7. The toothed locator 7 in turn rests inside on the base plate 1, which causes the slide member 6 and thus the carriage 3, 4 to be held in a selected position.

At the rear end of the guide plate 4, an eccentric 14 is supported rotatably about the axis 8, which eccentric bears against means, as a flange 3A, on the stepping plate 3. To rotate the eccentric, same is provided with a leverlike operating extension 15.

To adjust the thrust force, the eccentric 14 is caused to rotate. This moves the stepping plate 3 with or against the tension of the thrust springs 5 relative to the guide plate 4. An indicator 12, which projects into a recess 13 of the guide plate 4, indicates the magnitude of the adjusted thrust force, which is chosen according to the requirements. The eccentric 14 remains then in a pivoted position. The locking of the carriage 3, 4 is now released by moving the slide member 6 by an easy pressure against the force of the spring 10, namely until the teeth of the toothed locator 7 disengage the toothed rail 9. The carriage 3, 4 can now be moved sufficiently to enable the binding carried thereon to rest against the ski boot. The slide is now released and the teeth of the toothed locator 7 again engage the toothed rail 9 so that the carriage 3, 4 is again fixed in a selected position. The eccentric 14 is now swung back into its initial position, the thrust springs 5 will act fully and press the binding part accordingly against the ski boot. The selection of the initial stress of the spring or the magnitude of the thrust force can thus be carried out without requiring the ski boot to be present.

The invention is not limited to the illustrated exemplary embodiments. There are numerous possible modifications which lie within the scope of the invention. For example, it would be possible to support the eccentric also on the stepping plate and to rest same on the guide plate. It would also be possible advantageously to hold the eccentric at least in one end position by a lock.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An adjusting mechanism for a ski binding, comprising:

base means;

guide means on said base means;

carriage means movably guided on said guide means, said carriage means comprising first and second relatively movable and parallel plates movable in directions parallel to said guide means, one of said first and second plates having said ski binding mounted thereon and movable therewith;

resilient means connected to and extending between said first and second plates for resiliently urging said first and second plates in opposite directions;

fixed stop means mounted on one of said first and second plates;

adjustable stop means mounted on the other of said first and second plates for movement into and out of engagement with said fixed stop means for initially adjusting the relative position between said first and second plates and establishing a selected preloaded return force for said resilient means; and releasable locking means for releasably locking said carriage means to said base means.

2. The adjusting mechanism according to claim 1, wherein said adjustable stop means includes an eccentric rotatably supported on said other of said first and second plates.

3. The adjusting mechanism according to claim 2, wherein said adjustable stop means further includes a manually engageable extension operatively connected to said eccentric.

4. The adjusting mechanism according to claim 1, wherein said resilient means includes an indicating device which indicates the relative position of said first and second plates and, consequently, said return force of said resilient means.

5. The adjusting mechanism according to claim 1, wherein said ski binding is mounted on said first plate and wherein said second plate is mounted between said base means and said first plate; and wherein said releasable locking means is provided between said base means and said second plate.

* * * * *